US005924903A

United States Patent [19]

Takemura

[11] Patent Number: 5,924,903

[45] Date of Patent: Jul. 20, 1999

[54] METHOD OF FABRICATING A COLD CATHODE FOR FIELD EMISSION

[75] Inventor: Hisashi Takemura, Tokyo, Japan

[73] Assignee: NEC Corporation, Tokyo, Japan

[21] Appl. No.: 08/796,553

[22] Filed: Feb. 7, 1997

[30] Foreign Application Priority Data

Feb. 7, 1996 [JP] Japan ..... 8-021352

[51] Int. Cl.[6] ..... H01J 9/02

[52] U.S. Cl. ..... 445/50

[58] Field of Search ..... 445/24, 50

[56] References Cited

U.S. PATENT DOCUMENTS

| | | | |
|---|---|---|---|
| 5,199,917 | 4/1993 | MacDonald et al. . | |
| 5,201,992 | 4/1993 | Marcus et al. . | |
| 5,775,968 | 7/1998 | Toyoda et al. | 445/24 |

FOREIGN PATENT DOCUMENTS

| | | |
|---|---|---|
| A 0637050 | 2/1995 | European Pat. Off. . |
| A 2709206 | 2/1995 | France . |
| 395829 | 4/1991 | Japan . |
| 594762 | 4/1993 | Japan . |
| 7-65706 | 3/1995 | Japan . |

OTHER PUBLICATIONS

K. Koga et al., "New Structure Si Filed Emitter Arrays with Lower Operation Voltage".

Patent Abstracts of Japan, Abstract of JP–A 3 095 829.

Patent Abstracts of Japan, Abstract of JP–A 5 094 762.

Koga et al, "New Structure Si Filed Emitter Arrays with Low Operation Voltage", *International Electron Device Meeting* (*IEDM*), 1994, pp. 23–26.

*Primary Examiner*—Kenneth J. Ramsey

*Attorney, Agent, or Firm*—Sughrue, Mion, Zinn, Macpeak & Seas, PLLC

[57] ABSTRACT

A method is for use in fabricating a cold cathode comprising a sharp emitter (3) having a sharp tip that is formed on a silicon substrate 1*b*. The method comprises a first step of forming an intermediate emitter on the silicon substrate. The intermediate emitter has first and second emitter regions (33,34). The second emitter region is positioned under the first emitter region and has a width (diameter) larger than that of the first emitter region. The method further comprises a second step of processing the intermediate emitter into the sharp emitter by oxidation.

8 Claims, 16 Drawing Sheets

METHOD OF FABRICATING A COLD CATHODE FOR FIELD EMISSION

BACKGROUND OF THE INVENTION

This invention relates to a method of fabricating a cold cathode for field emission, more particularly, to a method of fabricating a cold cathode having a sharp emitter.

In general, it is known that a cold cathode has an emitter which emits electrons by field effect. The cold cathode may be used in a key device in vacuum microelectronics.

On fabricating the cold cathode, silicon is used since fine patterns may be easily formed with high precision. A conventional method is disclosed in Japanese Patent Publication Tokkai Hei 5-94762 (94762/1993).

The conventional method comprises a step of etching silicon substrate by isotropic etching to form a sharp emitter on the silicon substrate. The sharp emitter has a cone shape. Inasmuch as the isotropic etching is used in the conventional method on forming the sharp emitter on the silicon substrate, it is difficult to control an etching time for sharp emitter in the conventional method. In order to easily control the etching time for the sharp emitter, an improved method is disclosed in Japanese Patent Publication Tokkai Hei 3-95829 (95829/1991) and will be referred to as a first conventional method. Oxidation is used in the first conventional method on forming the sharp emitter on the silicon substrate.

Furthermore, another improved method is disclosed in "New Structure Si Field Emitter Arrays with Low Operation Voltage" which is published in International Electron Device Meeting (IEDM), 1994, pages 23 to 26 and will be referred to as a second conventional method. Anisotropic etching is used in the second conventional method on forming the sharp emitter on the silicon substrate.

However, it is difficult to make the sharpness of the emitter be good in the first conventional method inasmuch as oxidation is used in the first conventional method on forming the sharp emitter on the silicon substrate. Furthermore, it is difficult to control the height of the sharp emitter at a high accuracy in the first conventional method. As a result, it is difficult to stably form the sharp emitter on the silicon substrate in the first conventional method.

Similarly, it is difficult to stably form the sharp emitter on the silicon substrate in the second conventional method as will be later described.

SUMMARY OF THE INVENTION

It is therefore an object of this invention to provide a method capable to stably form a sharp emitter on a silicon substrate on fabricating a cold cathode.

Other objects of this invention will become clear as the description proceeds.

According to this invention, there is provided a method of fabricating a cold cathode comprising a sharp emitter having a sharp tip that is formed on said silicon substrate. The method comprises a first step of forming an intermediate emitter on the silicon substrate. The intermediate emitter has a first emitter portion and a second emitter portion positioned under the first emitter portion. The second emitter portion has a diameter or a width larger than that of the first emitter portion. The method further comprises a second step of processing the intermediate emitter into the sharp emitter by oxidation.

DESCRIPTION OF THE PREFERRED EMBODIMENTS

Figure 1A:
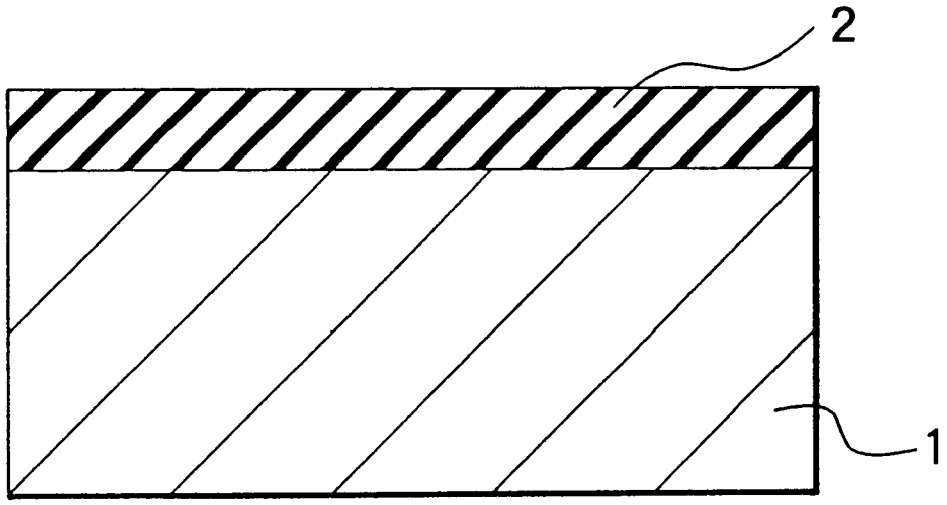
FIG. 1A PRIOR ART
FIGS. 1A through 1F are a process for describing a first conventional method of fabricating a cold cathode.
Figure 1B:
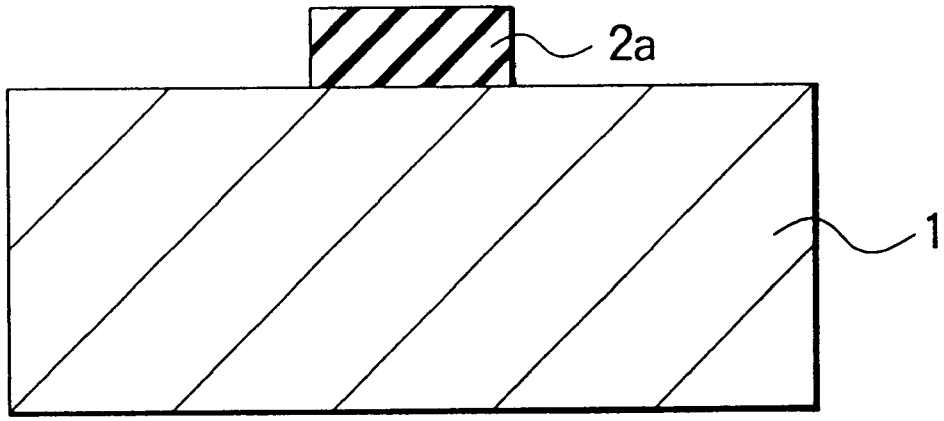
FIG. 1B PRIOR ART
Figure 1C:
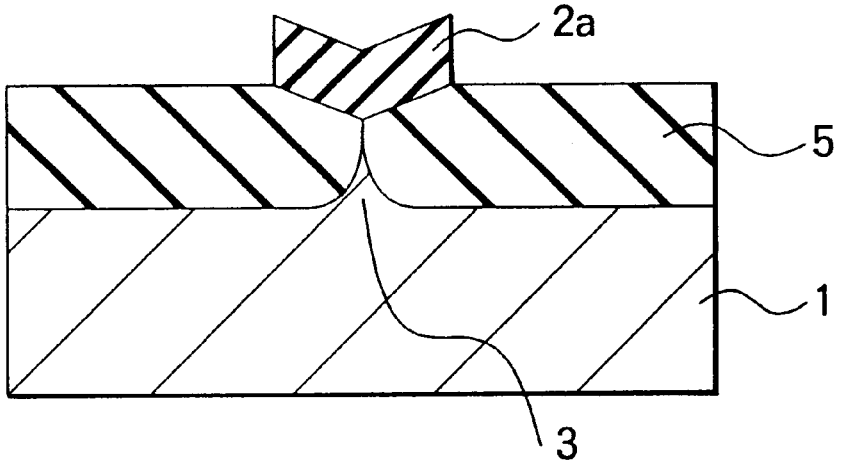
FIG. 1C PRIOR ART

Referring to FIGS. 1A through 1F, description will first be made as regards a first conventional method of fabricating a cold cathode. On fabricating the cold cathode, a silicon substrate 1 of n type is prepared which has a front surface and a rear surface directed upwards and downwards in FIG. 1A, respectively. By chemical vapor deposition (CVD), a nitride film 2 is deposited on a front surface of the silicon substrate 1 to the thickness of about 0.5 $\mu$m (FIG. 1A). By ion etching, the nitride film 2 is etched into an etched nitride film 2*a* which has a height (thickness) of about 0.5 $\mu$m as shown in FIG. 1B. The etched nitride film 2*a* may have a diameter or width of about 1 $\mu$m. By thermal oxidation, the silicon substrate 1 is oxidized at a temperature of about 1000° C. in order to form an oxide film 5. The oxide film 5 has a thickness of about 0.5 $\mu$m at a region having no nitride film. As shown in FIG. 1C, a cone-shaped emitter portion 3*a* is formed under the etched nitride film 2*a* in this step.

Figure 1D:
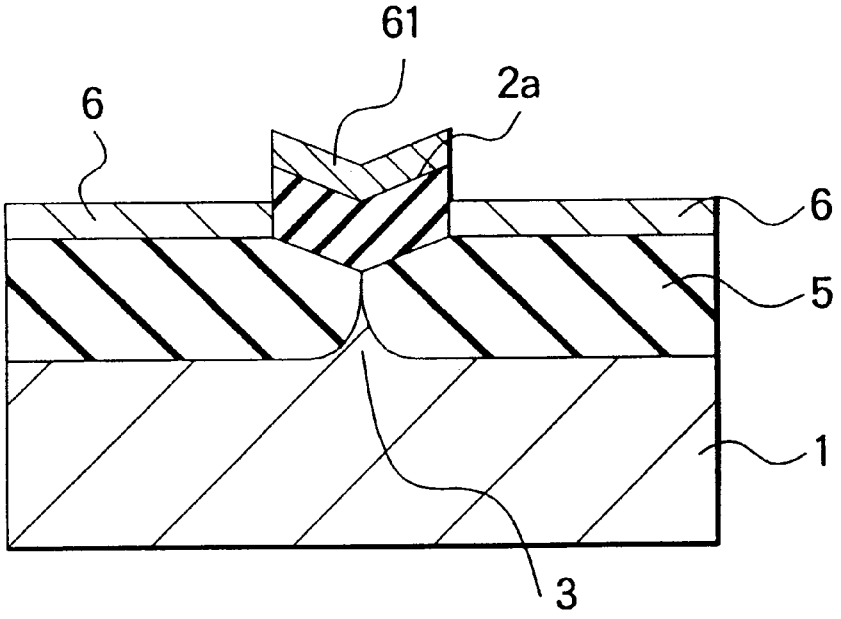
FIG. 1D PRIOR ART
Figure 1E:
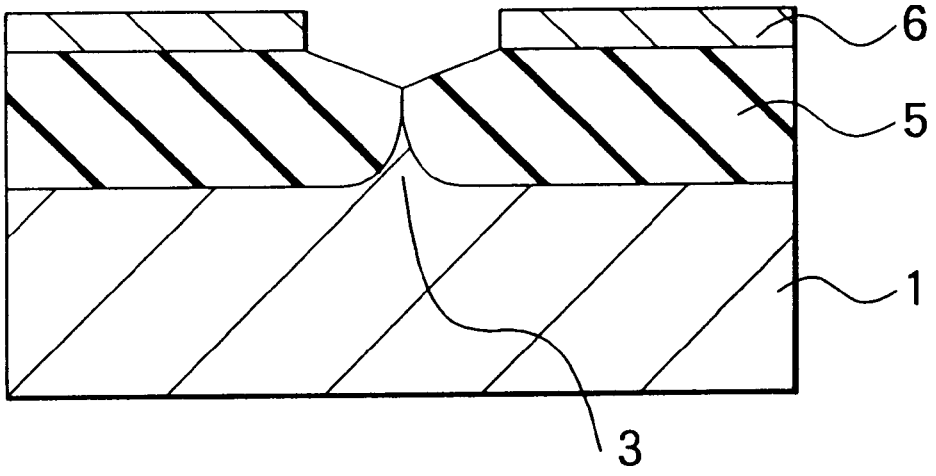
FIG. 1E PRIOR ART
Figure 1F:
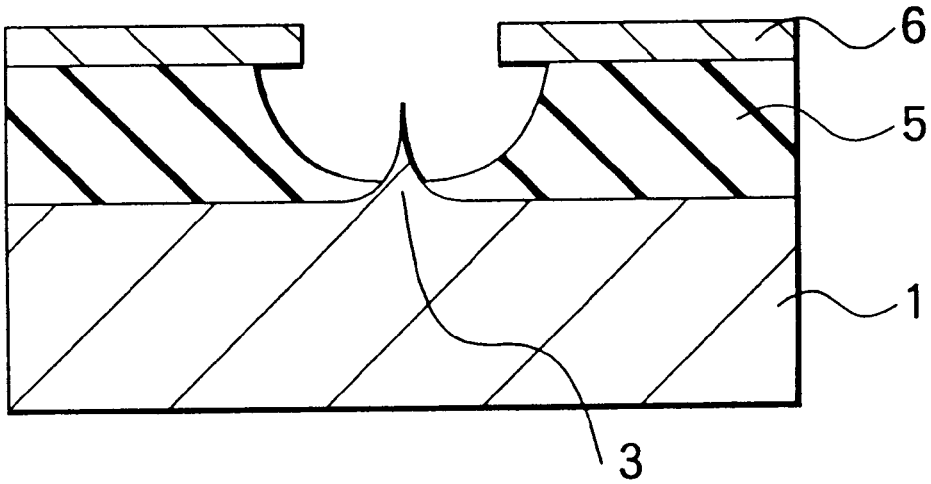
FIG. 1F PRIOR ART

By vacuum evaporation, metal electrode films 6 and 61 are deposited on the oxide film 5 and the etched nitride film 2*a*, respectively, as shown in FIG. 1D. Each of the metal electrode films 6 and 61 has a thickness of about 100nm and may be composed of Mo. By using the vapor deposition, it is possible to separate the metal electrode film 61 from the metal electrode film 6. By using an etchant such as phosphoric acid, the etched nitride film 2*a* is removed from the silicon substrate 1 as shown in FIG. 1E. The metal electrode film 61 is lifted off at a time to be removed from the silicon substrate 1. As shown in FIG. 1F, the oxide film 5 around the emitter 3 is removed by an etchant such as hydrofluoric acid in order to expose the emitter 3.

By the way, the cold cathode for field emission comprises a plurality of emitters although only one emitter is illustrated in FIGS. 1A through 1F. In order to operate the cold cathode at a low voltage with a good controllability and a high field emission characteristic, it is necessary to increase the emitters in number and to uniformly increase field strength at tips of the emitters.

In order to increase the field strength at the tips of the emitters, it is effective to shorten a distance between each emitter and each gate. Furthermore, it is effective to sharpen the tip of each emitter and to make each emitter be higher than the lower surface of the metal electrode film which is used as the gate. Specifically, it is necessary to make the emitter become sharp and to control the height of the emitter with accuracy.

Inasmuch as the emitters are formed by oxidation in the first conventional method, it is possible to uniformly form the emitters with a high controllability in comparison with isotropic etching.

However, the height of each emitter is determined by thickness of the oxide film 5 and the oxide film 5 is used as an insulating film for the metal electrode film 6 in the first conventional method. As a result, the tip of each emitter is positioned under the insulating film. It is impossible to make each emitter become higher than the metal electrode film 6 for the gate in the first conventional method.

Furthermore, it is difficult to oxidize the silicon just under the nitride film 2*a* which may be a film of oxidation resistance. As a result, the silicon remains as a remaining silicon just under the nitride film 2*a* in the first conventional method inasmuch as it is difficult to carry out oxidation toward a transverse direction parallel to the rear surface of the silicon substrate 1. As a result, the height of each emitter is further reduced in the first conventional method. Therefore, it is impossible to make the electric field become great at the tip of each emitter inasmuch as the tip of each emitter is positioned below the metal electrode film 6 for the gate.

In addition, the height of each emitter is determined by the thickness of the oxide film 5 that is determined by the width (diameter) of the nitride film 2*a* used as the mask. For example, the thickness of the oxide film 5 is approximately equal to a half width (diameter) of the nitride film 2*a*. More particularly, it is necessary to form the nitride film 2*a* having the diameter of about 2 μm on forming the emitter having height of about 1 μm. On forming the emitter having height of about 0.5 μm, it is necessary to form the nitride film 2*a* having the diameter of about 1 μm.

As readily understood from the description, it is necessary to make a pitch between emitters be at least twice the height of each emitter. As a result, it is difficult to increase emitters in number in the cold cathode in the first conventional method.

Figure 2A:
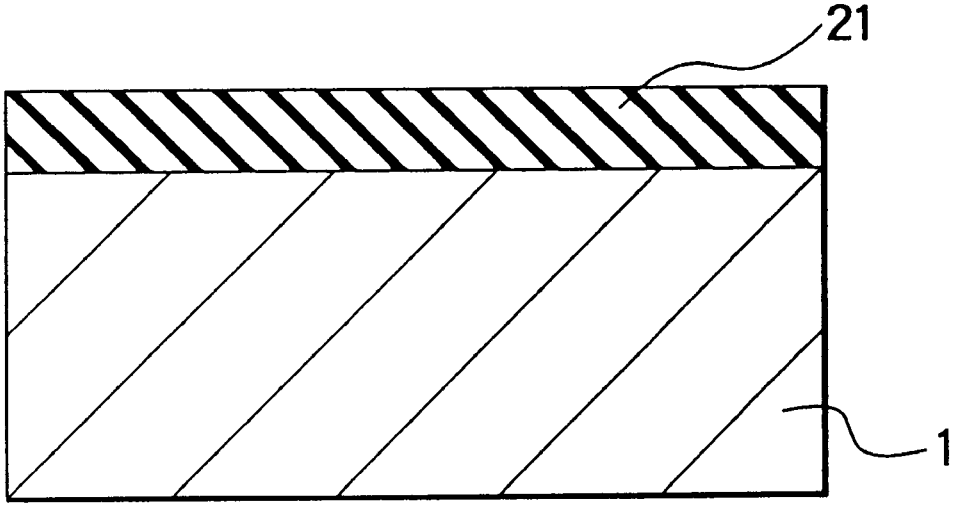
FIG. 2A PRIOR ART
FIGS. 2A through 2F are a process for describing a second conventional method of fabricating a cold cathode.
Figure 2B:
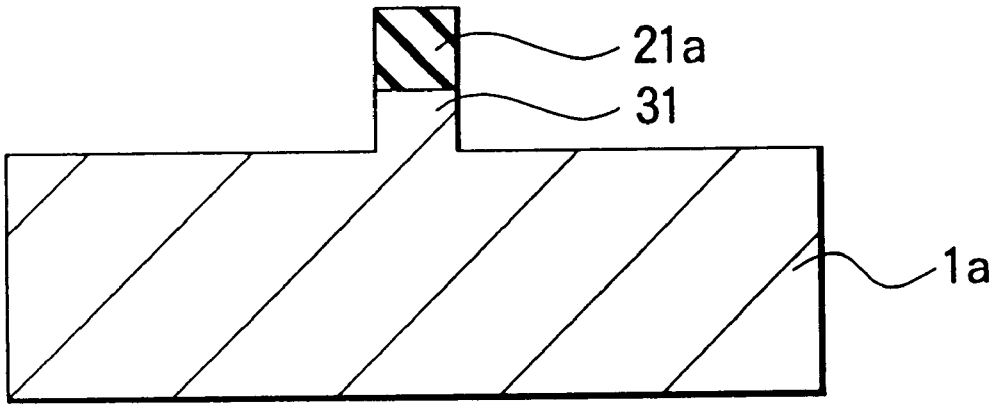
FIG. 2B PRIOR ART

Referring to FIGS. 2A through 2F, description will be made about a second conventional method of fabricating a cold cathode. On fabricating the cold cathode, the silicon substrate 1 of n type is prepared which has the front surface and the rear surface directed upwards and downwards in FIG. 2A, respectively. The silicon substrate 1 is oxidized by thermal oxidation in order to form an oxide film 21 on the silicon substrate 1 to the thickness of about 0.5 μm (FIG. 2A). After a resist mask (not shown) is formed on a predetermined region of the oxide film 21, the oxide film 21 is selectively removed to form a patterned oxide film 21*a*. After removing the resist mask, the silicon substrate 1 is etched into an etched silicon substrate 1*a* by anisotropic etching by using the patterned oxide film 21*a* as a mask in order to form a projection region 31 as shown in FIG. 2B.

Figure 2C:
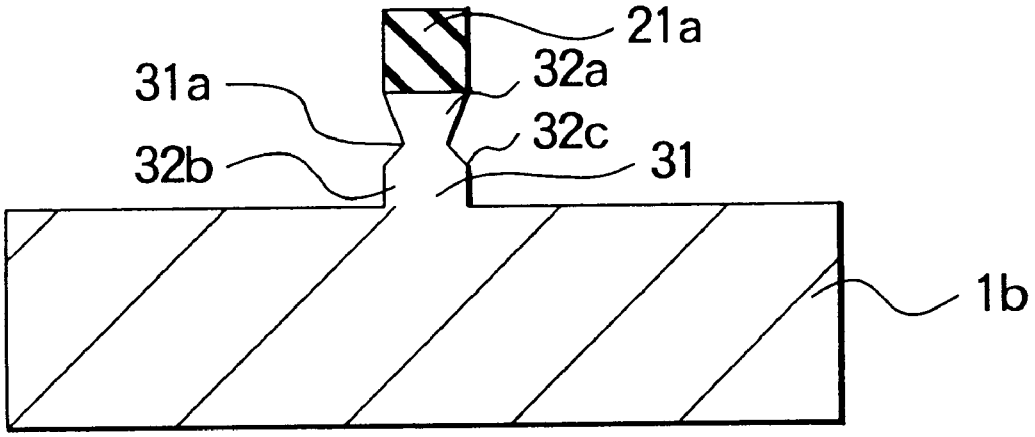
FIG. 2C PRIOR ART

By using the patterned oxide film 21*a* as the mask, the etched silicon substrate 1*a* is further etched into a further etched silicon substrate 1*b* by using an anisotropic chemical etchant such as ethylenediamine-pyrocathechol-water (EPW) as shown in FIG. 2C. In this step, an etching rate becomes low in a plane direction (331). As a result, the projection region 31 has a necking portion 31*a* as shown in FIG. 2C.

The projection portion 31 comprises an emitter sharp region 32*a* having the necking portion 31*a* and an emitter base region 32*b* positioned below the emitter sharp region 32*a*. The width (diameter) of the emitter sharp region 32*a* is not greater than that of the etched oxide film 21*a*. Similarly, the width (diameter) of the emitter base region 32*b* is not greater than that of the etched oxide film 21*a*. A connection portion 32*c* exists between the emitter sharp region 32*a* and the emitter base region 32*b*. The connection portion 32*c* has a predetermined angle.

Figure 2D:
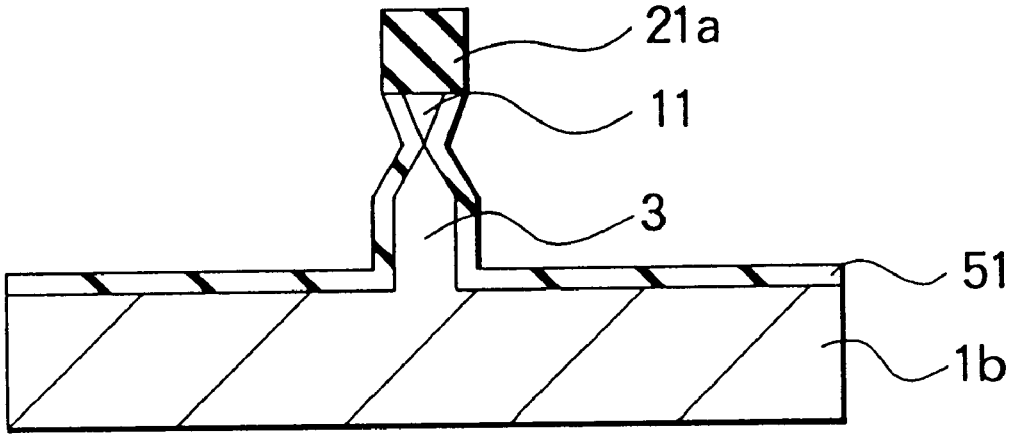
FIG. 2D PRIOR ART

After the etched silicon substrate 1*a* is etched by anisotropic etching into the further etched silicon substrate 1*b* by using the patterned oxide film 21*a* as described above, thermal oxidation is carried out until a sharp tip shape is formed on the projection region 31. More specifically, the further etched silicon substrate 1*b* is oxidized by thermal oxidation until the projection region 31 has an emitter 3 having a sharp tip as shown in FIG. 2D. In this event, an oxide film 51 is formed on the further etched silicon substrate 1*b*, the emitter 3 and a silicon 11 which remains as a remaining silicon above the emitter without oxidation. The oxide film 51 may have, for example, a thickness of about 0.1 μm.

Figure 2E:
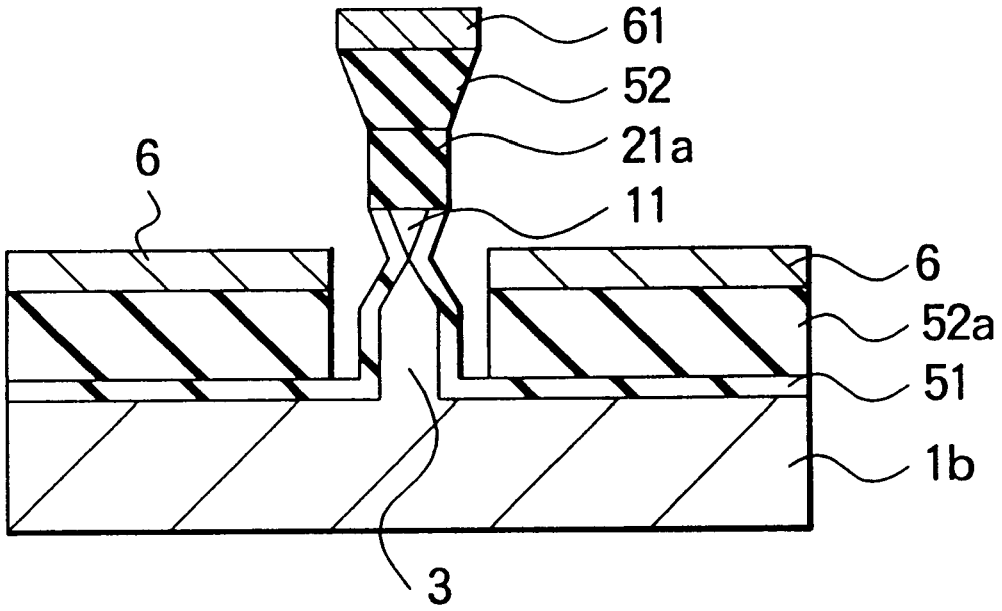
FIG. 2E PRIOR ART

By using vacuum evaporation, an oxide films 52 and 52*a* are deposited on the patterned oxide film 21*a* and oxide film 51, respectively. Each of the oxide films 52 and 52*a* has a thickness of about 0.4 μm. Furthermore, metal electrode films 6 and 61 are deposited on the oxide films 52 and 52*a*, respectively, as shown in FIG. 2E. Each of the metal electrode films 6 and 61 may be composed of Nb and has a thickness of about 0.2 μm.

Figure 2F:
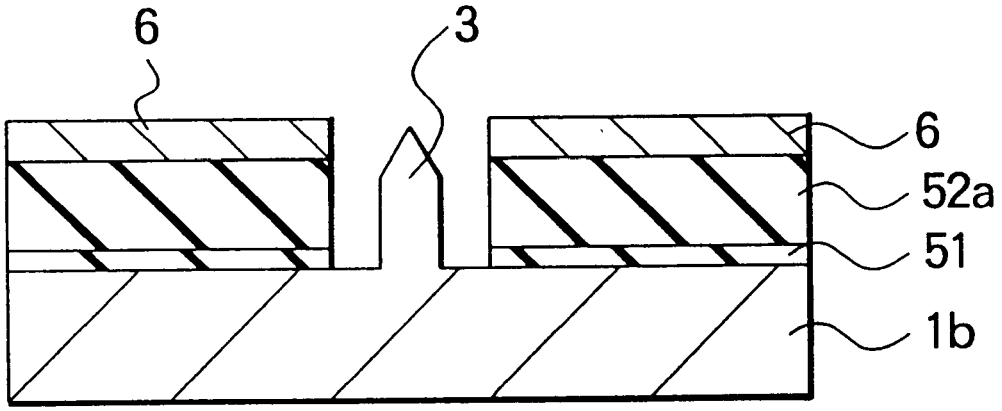
FIG. 2F PRIOR ART

An etching is carried out by using hydrofluoric acid in order to remove the patterned oxide film 21*a* and to partially remove the oxide film 51 around the emitter 3. In this event, the remaining silicon 11 and the metal electrode film 61 above the emitter 3 is removed by lift-off as shown in FIG. 2F. As a result, the cold cathode is fabricated which comprises the sharp emitter 3 having the sharp tip.

In the second conventional method, it is easy to control the height of the emitter inasmuch as a silicon etching step is carried out on controlling the height of the emitter as described above. As a result, it is possible to make the height of the emitter be higher than the metal electrode film for the gate. Furthermore, it is possible to make a mask size be small in comparison with the first conventional method.

However, it is difficult to determine an etching end point in the second conventional method inasmuch as the tip of the emitter is sharpened by wet etching. Accordingly, it is difficult for the second conventional method to have a good controllability on sharpening the tip of the emitter.

In addition, the silicon remains as the remaining silicon above the emitter in the second conventional method as described above. In order to remove the remaining silicon, it is necessary to carry out the lift-off on exposing the emitter. Even if the lift-off is carried out, the remaining silicon 11 slightly remains between the emitter 3 and the insulating film (oxide films 51 and 52*a*) and the metal electrode film 6 which is used as the gate. As a result, a leak current occurs between the emitter and the gate.

Furthermore, the second conventional method uses the etched oxide film 21*a* as the mask on adjusting the height of the emitter by dry etching. The etched oxide film 21*a* is also used as the mask in the anisotropic wet etching. It will be assumed that the necking portion 31*a* has a necking diameter in the emitter sharp region 32*a* and the emitter base region 32*b* has a base diameter. A diameter difference will be called a difference between the necking diameter and the base diameter. In the second conventional method, it is impossible to make the diameter difference be large. In this event, the emitter becomes fine under the thermal oxide film so that the emitter easily breaks when the thickness of a high insulating thermal oxide film becomes large on forming the emitter.

Figure 3A:
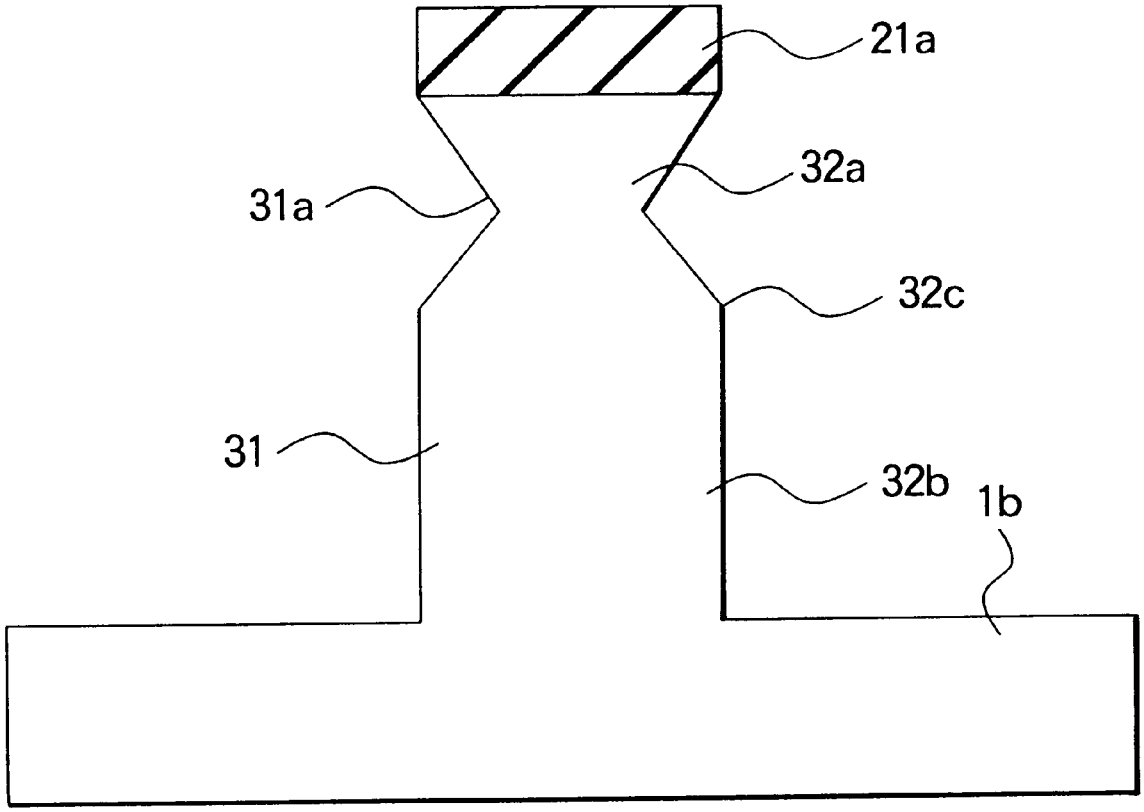
FIG. 3A PRIOR ART
FIGS. 3A and 3B are a sectional view for illustrating the cold cathode fabricated by the method illustrated in FIGS. 2A through 2F.
Figure 3B:
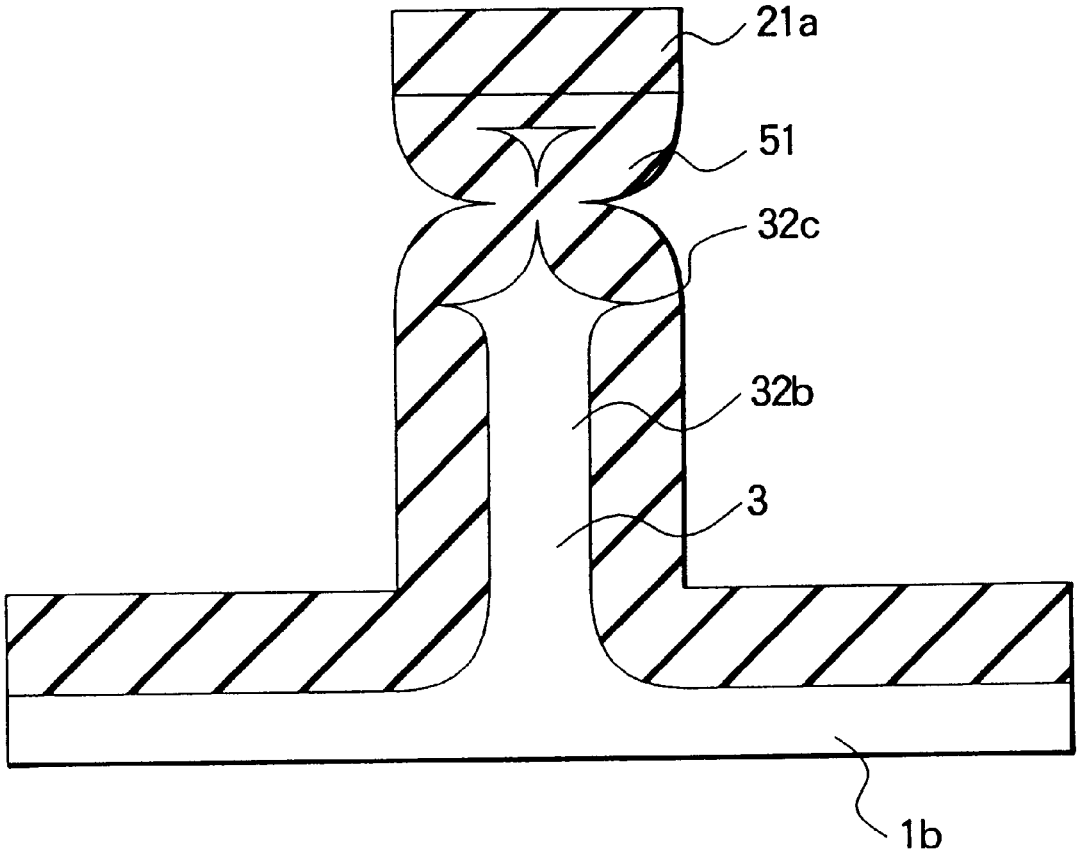
FIG. 3B PRIOR ART

Referring to FIGS. 3A and 3B, oxidation will be described which is carried out on sharpening the emitter in the second conventional method. FIG. 3A is for magnifying FIG. 2C and is for illustrating a shape prior to oxidation.

When oxidation is carried out under a condition illustrated in FIG. 3A, the oxidation becomes slow in the connection portion 32*c*. Finally, the emitter 3 becomes fine below the connection portion 32*c* as shown in FIG. 3B. As a result, the emitter 3 easily breaks in the emitter base region 32*b* in which the oxide film 51 has a large thickness.

As readily understood from the above-mentioned description, the thickness of the oxide film 51 is restricted which is formed by a high insulating thermal oxidation in the second conventional method. In order to ensure an insulation below the gate metal electrode, the oxide film 52*a* is deposited by vacuum evaporation. The oxide film 52*a* deposited by vacuum evaporation has an insulation ability less than the thermal oxide film 51. Accordingly, it is necessary to make the thickness of the oxide film 52*a* large. As a result, it is difficult to make the cold cathode to be a small size.

Figure 4A:
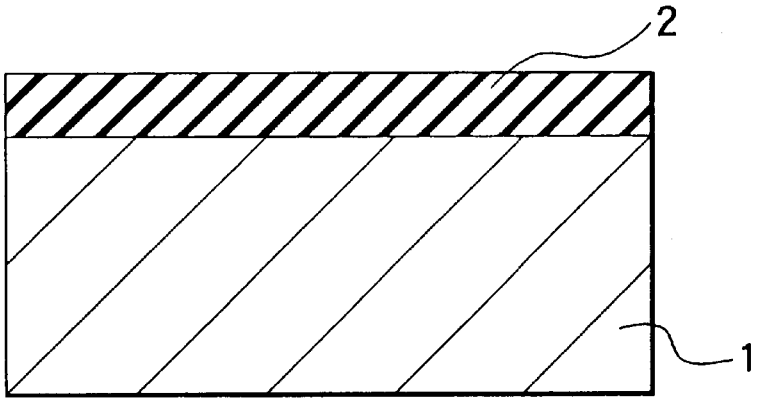
FIGS. 4A through 4H are a process for describing a method of fabricating a cold cathode according to a first embodiment of this invention.
Figure 4B:
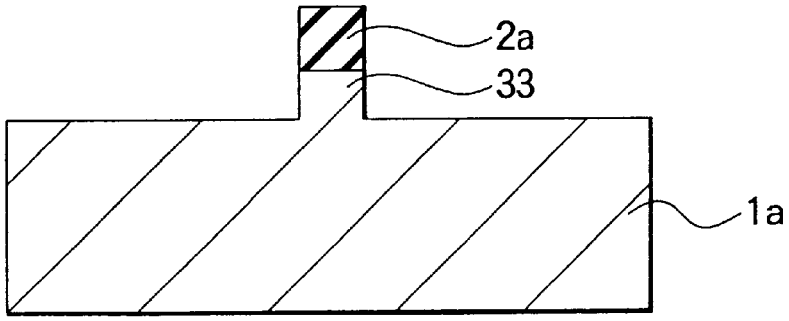

Referring to FIGS. 4A through 4H, description will proceed to a first embodiment of a method of fabricating a cold cathode according to this invention. On fabricating the cold cathode, a silicon substrate 1 of n type is prepared which has a front surface and a rear surface directed upwards and downwards in FIG. 4A, respectively. By chemical vapor deposition (CVD), a nitride film 2 is deposited on the front surface of the silicon substrate 1 to the thickness of about 100 nm (FIG. 4A). Next, etching is carried out by using a resist (not shown) as a mask in order to etch the nitride film 2 into an etched nitride film 2*a* as shown in FIG. 4B. The etched nitride film 2*a* has a width (diameter) of about 0.3 μm. The silicon substrate 1 is etched by anisotropic dry etching in order to remove the above-mentioned resist. As a result, the silicon substrate 1 is partially etched into an etched or exposed silicon substrate 1*a* till the depth of about 200 nm. An emitter sharp region 33 is formed on the silicon substrate 1*a* under the etched nitride film 2*a*.

Figure 4C:
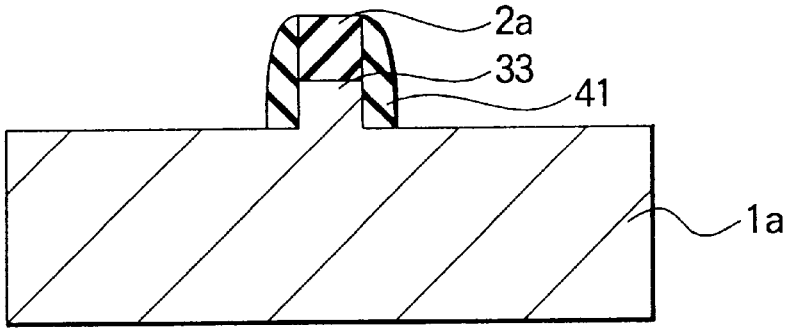

After an oxide film is deposited to thickness of about 200 nm by using a low pressure CVD, anisotropic dry etching is carried out in order to selectively remove the oxide film. As a result, the oxide film remains as a remaining oxide film 41 on side walls of the emitter sharp region 33 and the etched nitride film 2*a* as shown in FIG. 4C.

Figure 4D:
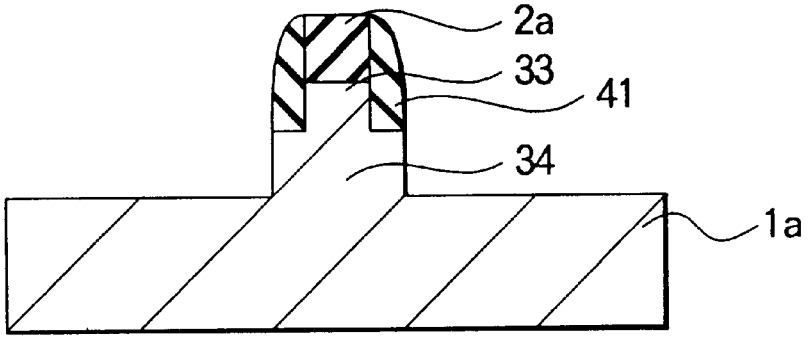

By using each of the etched nitride film 2*a* and the remaining oxide film 41 as a mask, the etched silicon substrate 1*a* is further etched into a further etched silicon substrate 1*b* till the depth of about 200 nm in order to form an emitter base region 34 as shown in FIG. 4D. The base region 34 is positioned under the emitter sharp region 33. The the emitter sharp region 33 may be called a first emitter portion. The emitter base region 34 may be called a second emitter portion. Namely, an intermediate emitter (emitter portion) is formed which comprises the first emitter portion 33 and the second emitter portion 34.

Figure 4E:
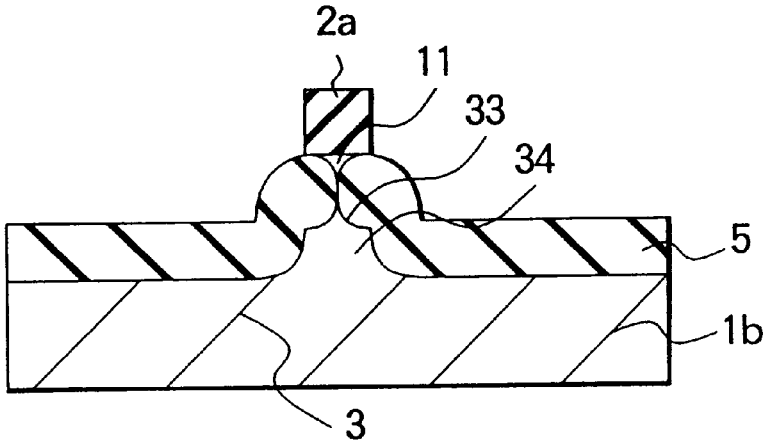

After the remaining oxide film 41 is selectively removed by using an etchant such as hydrofluoric acid, the further etched silicon substrate 1*b* is oxidized by thermal oxidation at a temperature of about 1000° C. in order to form an oxide film 5 on the further etched silicon substrate 1*b* as shown in FIG. 4E.

In a step illustrated in FIG. 4E, the emitter sharp region 33 is sharpened into a sharp tip of a sharp emitter 3 inasmuch as oxidation is carried out from the side wall of the emitter sharp region 33 to a transverse direction. In this event, the emitter sharp region 33 is not oxidized just under the etched nitride film 2*a*. As a result, it is possible to form the sharp emitter 3 having the sharp tip. Silicon may inevitably remain as a remaining silicon 11 just under the etched nitride film 2*a*.

As readily understood from the above-mentioned description, the diameter of the emitter base region 34 is larger than that of the emitter sharp region 33. More particularly, the diameter of the emitter base region 34 is equal to a value obtained by addition of twice thickness of the oxide film 41 and the diameter of the emitter sharp region 33. In the example being illustrated, the diameter of the emitter base region 34 is equal to about 700 nm inasmuch as the thickness of the oxide film 41 is about 200 nm and the diameter of the etched nitride film 2*a* is about 300 nm. Therefore, the emitter 3 does not become excessively fine even if oxidation is carried out to a depth of about 500 nm.

Figure 4F:
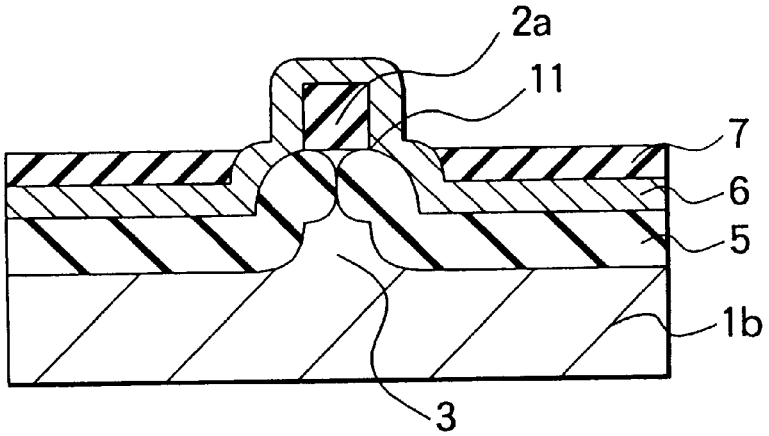

Next, a metal electrode film 6 is deposited to about 200 nm by using sputtering. The metal electrode film 6 is composed of Mo. After that, a plane film is applied as a resist on the metal electrode film 6 to form a resist film 7 by etch back as shown in FIG. 4F. The resist film 7 is used as an etching mask for the metal electrode film 6.

Figure 4G:
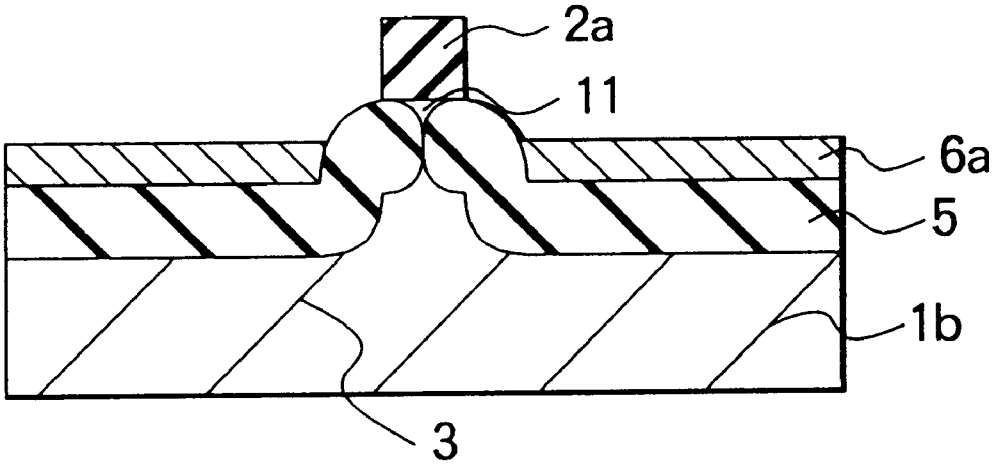
Figure 4H:
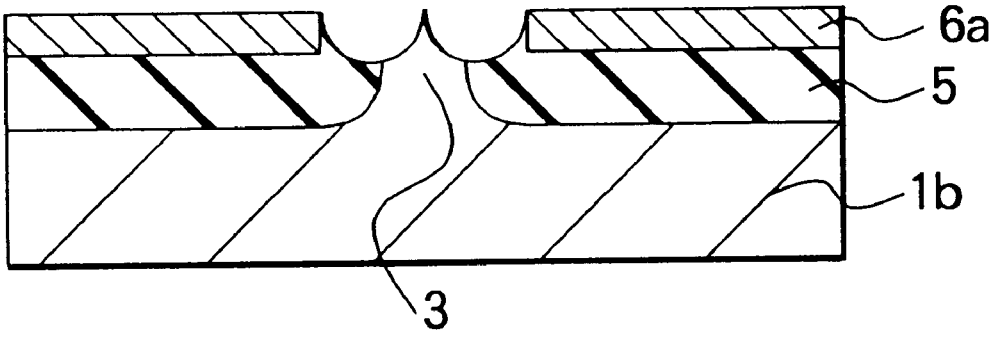

After metal electrode film is etched into an etched metal electrode film 6a, the resist film 7 is removed as shown in FIG. 4G. After the etched nitride film 2*a* and the remaining silicon 11 is removed by etching, the oxide film 5 partially is etched by using hydrofluoric acid in order to expose the emitter 3 as shown in FIG. 4H.

As described above, the intermediate emitter comprises the emitter sharp region 33 and the emitter base region 34 in the first embodiment in a condition prior to oxidation for sharpening the intermediate emitter into the sharp emitter 3. The diameter of the emitter base portion 34 is larger than that of the emitter sharp region 33. As a result, the sharpness of the sharp emitter 3 is controlled in the emitter sharp region 34. The height of the sharp emitter 3 is controlled in accordance with the height of the emitter base region 34. Therefore, it is possible to increase controllabilities of both of the sharpness and the height of the sharp emitter 3 with accuracy.

In addition, the diameter of the emitter sharp region 33 is determined by once patterning in the first embodiment. The diameter of the emitter base region 34 is determined by the thickness of the oxide film 41 which is formed on the side wall of the emitter sharp region 33. Therefore, it is possible to make the diameter of the sharp emitter 3 be a desired value by controlling the thickness of the oxide film 41 formed on the side wall of the emitter sharp region 33.

Furthermore, it is possible to sharpen the sharp emitter 3 by using a thick thermal oxide film in the first embodiment. Inasmuch as the thermal oxide film is used as the insulating film under the gate, it is possible to ensure the insulation and to simplify fabricating steps.

Figure 5A:
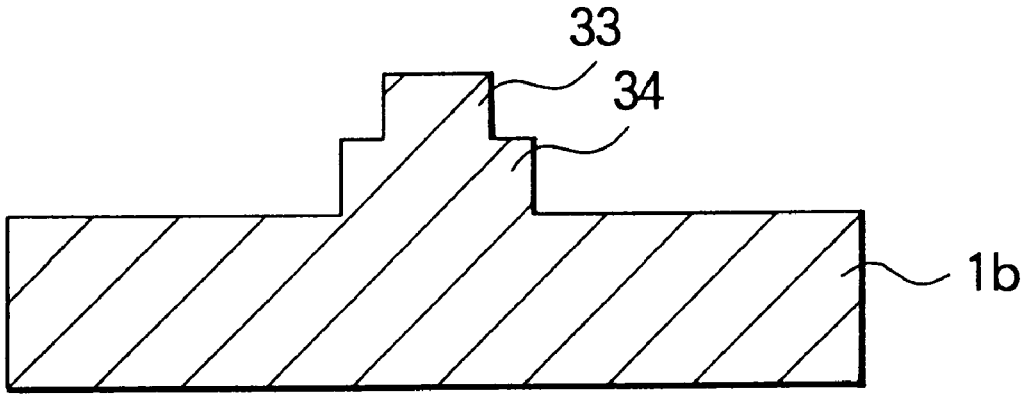
FIGS. 5A through 5D are a process for describing a method of fabricating a cold cathode according to a second embodiment of this invention.

Referring to FIGS. 5A through 5D, description will proceed to a second embodiment of a method of fabricating a cold cathode according to this invention. In the second embodiment, the steps are carried out which are described in conjunction with FIGS. 4A through 4D. After that, the etched nitride film 2*a* and oxide film 41 are removed in order to expose the further etched silicon substrate 1*b* as shown in FIG. 5A. The etched nitride film 2*a* is removed by using an etchant such as phosphoric acid. The oxide film 41 is removed by using an etchant such as hydrofluoric acid.

Figure 5B:
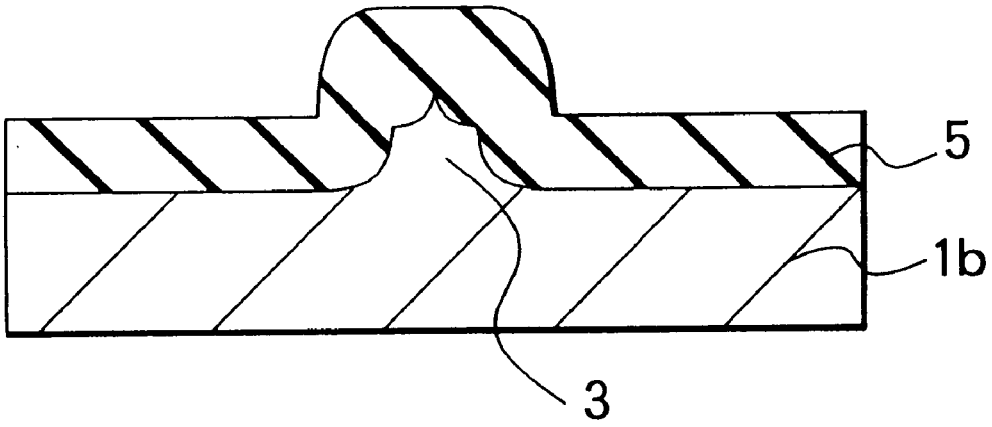
Figure 5C:
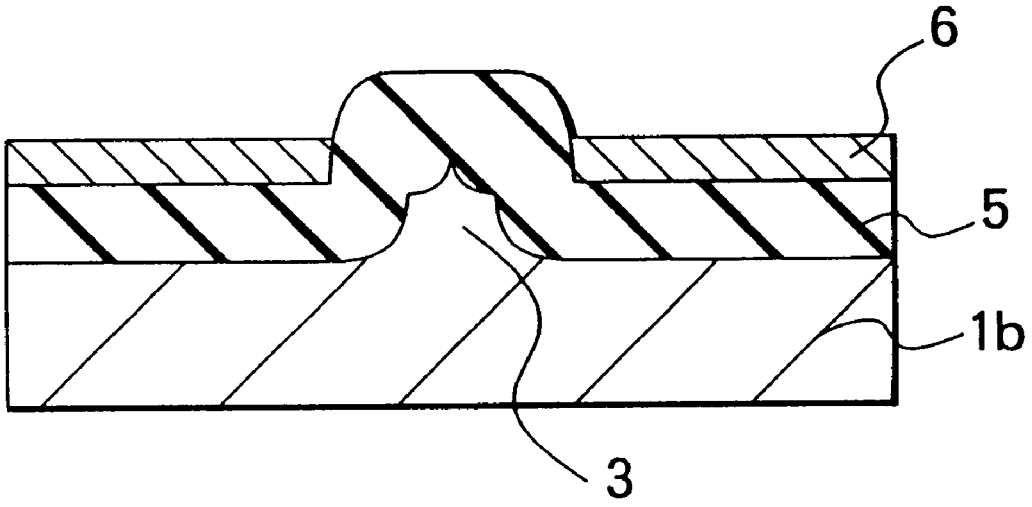
Figure 5D:
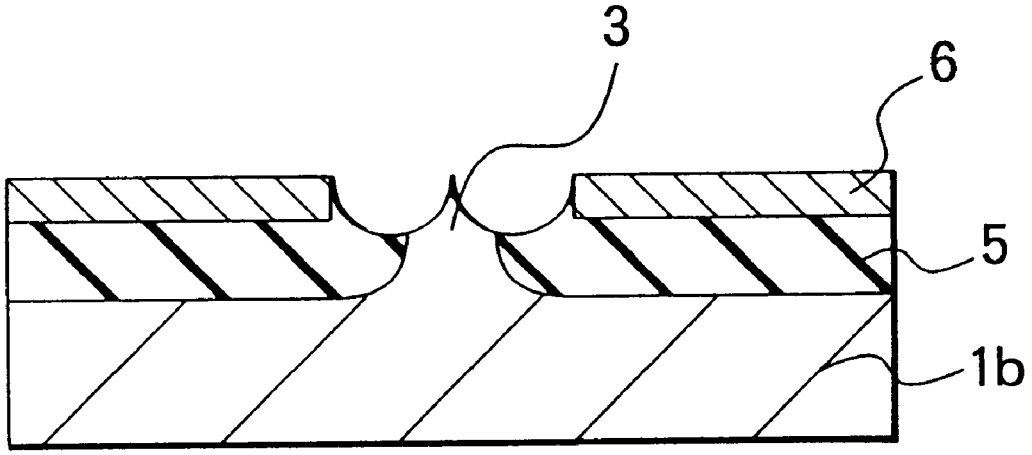

Next, thermal oxidation is carried out at a temperature of about 1000° C. in order to form the sharp emitter 3 having the sharp tip. The thermal oxidation is carried out until the sharp emitter 3 is formed. The oxide film 5 is formed on the further etched silicon substrate 1*b* to the thickness of about 500 nm as shown in FIG. 5B. A metal film composed of Mo is deposited to about 200 nm by using sputtering. In a similar manner described in conjunction with the first embodiment, the metal film is selectively removed by the etch back step to form the metal electrode film 6 for the gate as shown in FIG. 5C. By using hydrofluoric acid, the oxide film 5 is selectively etched on the emitter 3 in order to expose the emitter 3 as shown in FIG. 5D.

As readily understood from the above-mentioned description, the etched nitride film 2*a* is removed in a condition prior to oxidation for forming the sharp emitter 3 in the second embodiment. Inasmuch as the remaining silicon remains above the sharp emitter 3, it is unnecessary to carry out a silicon removing step or a lift off step.

Figure 6A:
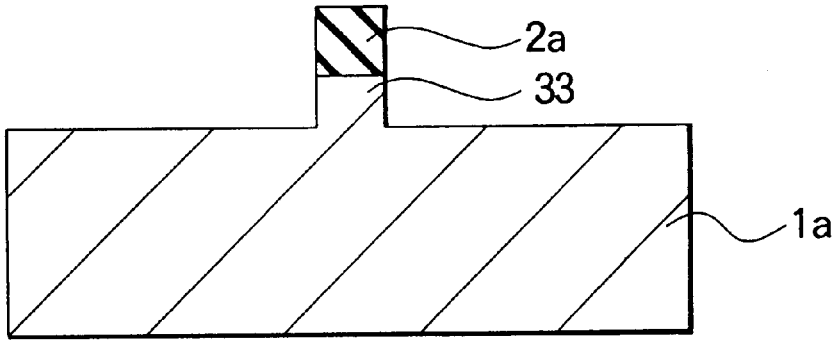
FIGS. 6A through 6H are a process for describing a method of fabricating a cold cathode according to a third embodiment of this invention.

Referring to FIGS. 6A through 6H, description will proceed to a third embodiment of a method of fabricating a cold cathode according to this invention. On fabricating the cold cathode, a silicon substrate 1 of n type is prepared which has a front surface and a rear surface directed upwards and downwards in FIG. 6A, respectively. By chemical vapor deposition (CVD), a nitride film 2 is deposited on the front surface of the silicon substrate 1 to the thickness of about 100 nm. Selective etching is carried out by using a resist (not shown) as a mask in order to form the etched nitride film 2*a* as shown in FIG. 6A. The etched nitride film 2*a* has a diameter of about 0.3 $\mu$m. The silicon substrate 1 is etched into an etched silicon substrate 1*a* by anisotropic dry etching till the depth of about 200 nm. As a result, the emitter sharp region 33 is formed on the etched silicon substrate 1*a* under the etched nitride film 2*a* as shown in FIG. 6A.

Figure 6B:
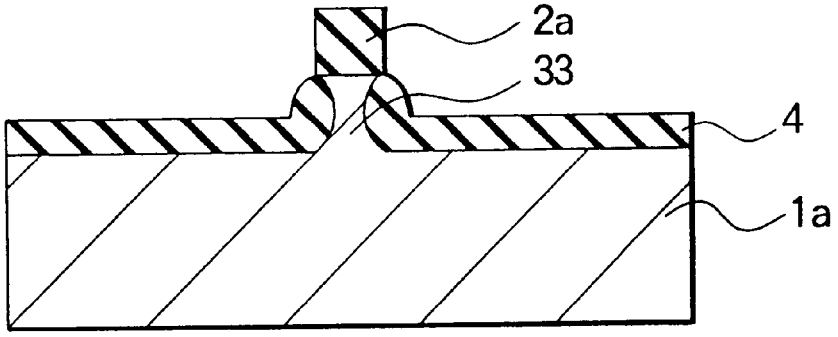
Figure 6C:
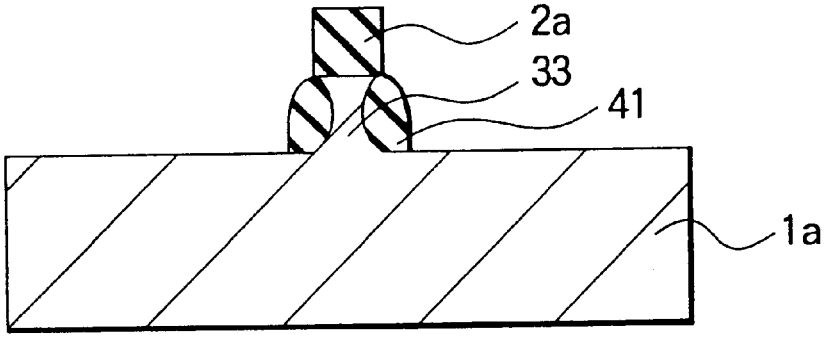
Figure 6D:
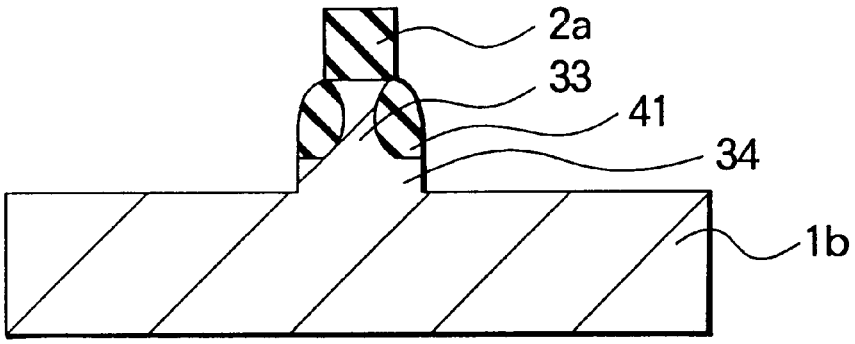

Thermal oxidation is carried out at a temperature of about 1000° C. in order to form the oxide film 4 to thickness of about 200 nm as shown in FIG. 6B. In this step, the emitter sharp region 33 has a necking portion of which diameter is about 100 nm. By using anisotropic dry etching, the oxide film 4 is selectively etched into the remaining oxide film 41 which is positioned on the side wall of the emitter sharp region 33 as shown in FIG. 6C. By using each of the etched nitride film 2*a* and the remaining oxide film 41, the etched silicon substrate 1*a* is further etched into the further etched silicon substrate 1*b* by anisotropic dry etching till the depth of about 300 nm in order to form the emitter base region 34 as shown in FIG. 6D. As a result, the emitter base region 34 has a diameter larger than about 500 nm.

Figure 6E:
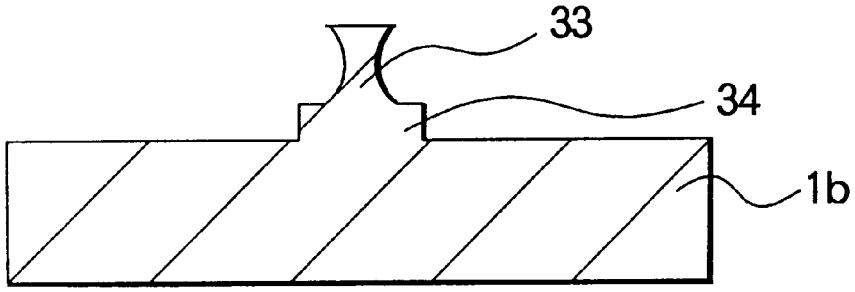
Figure 6F:
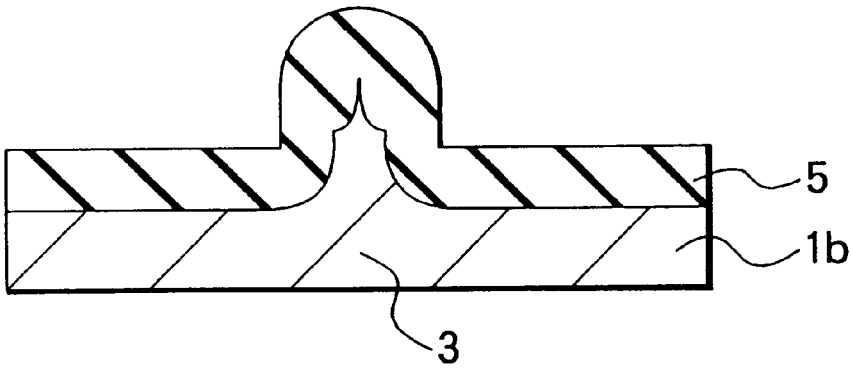

The etched nitride film 2*a* and the oxide film 41 are etched by phosphoric acid and hydrofluoric acid, respectively, in order to expose the further etched silicon substrate 1*b* as shown in FIG. 6E. As shown in FIG. 6F, thermal oxidation is carried out at a temperature of about 1000° C. in order to form the oxide film 5 which has the thickness of about 350 nm. In this step, the sharp emitter 3 is formed which has a predetermined sharpness and a predetermined height. Inasmuch as the emitter sharp region 33 has a diameter smaller than that of the etched nitride film 2*a* which is used as the mask, it is possible to form the sharp emitter 3 even if the thickness of the oxide film 5 is thin.

Figure 6G:
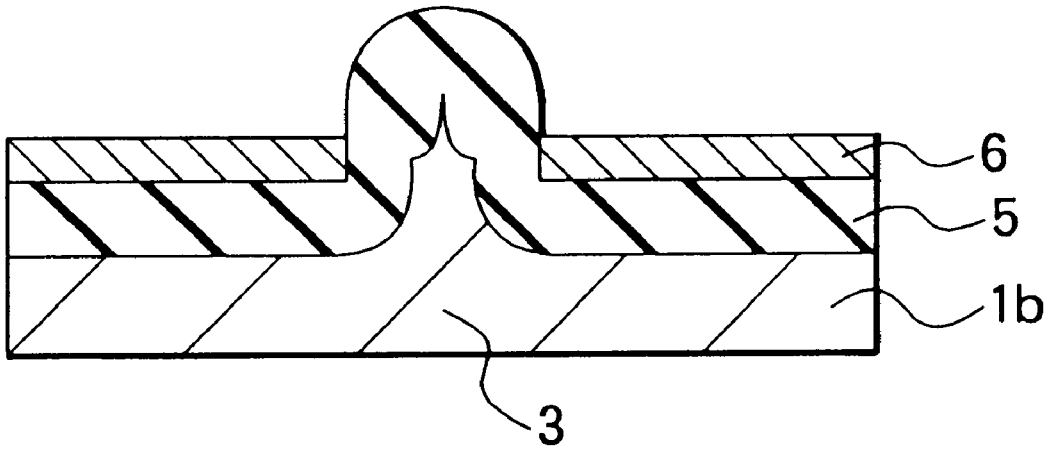
Figure 6H:
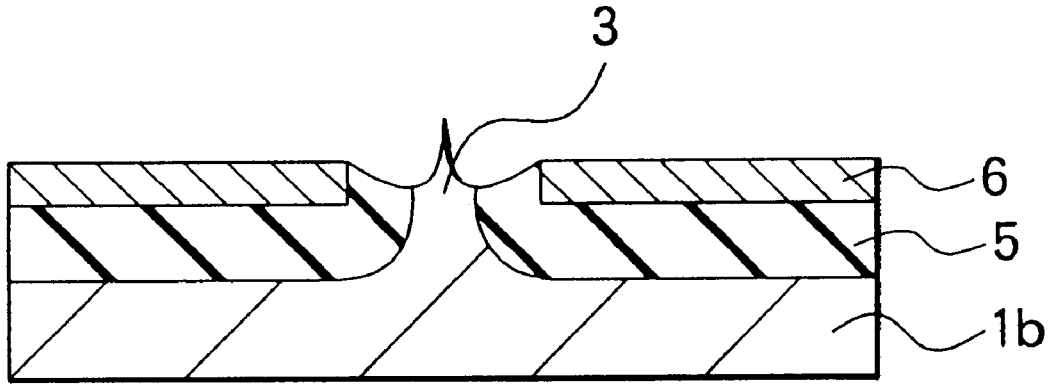

A metal film composed of Mo is deposited to about 200 nm by using sputtering. In a similar manner described in conjunction with the first embodiment, the metal film is selectively removed by the etch back step to form the metal electrode film 6 for the gate as shown in FIG. 6G. By using hydrofluoric acid, the oxide film 5 is selectively etched on the emitter 3 in order to expose the emitter 3 as shown in FIG. 6H.

As described above, controllability of process becomes high in the third embodiment inasmuch as thermal oxidation is used on forming the sharp emitter having the sharp tip. Inasmuch as oxidation is used on forming the oxide film on the side wall of the emitter sharp region, it is possible to increase a diameter difference between the emitter sharp region and the emitter base region in the third embodiment. As a result, it is possible to form the sharp emitter having the sharp tip with ensuring a base portion of the emitter in the third embodiment.

While this invention has thus far been described in conjunction with the preferred embodiments thereof, it will readily be possible for those skilled in the art to put this invention into practice in various other manners. For example, the intermediate emitter may have first through N-th emitter regions, where N represents a positive integer which is greater than one.

What is claimed is:

1. A method of fabricating a cold cathode comprising a sharp emitter having a sharp tip that is formed on a silicon substrate, wherein said method comprises:

a first step of forming an intermediate emitter on said silicon substrate, said intermediate emitter having at least first and second emitter portions, said second emitter portion being positioned under said first emitter portion, and having a width longer than that of said first emitter portion, wherein said width of said first emitter portion is constant and said width of said second emitter portion is constant; and a second step of processing said intermediate emitter into said sharp emitter by oxidation.

2. A method as claimed in claim 1, wherein said sharp emitter is composed of silicon.

3. A method as claimed in claim 1, wherein:

said sharp emitter is composed of silicon;

said first emitter portion being shaped into a sharp emitter portion in said intermediate emitter when said intermediate emitter is processed into said sharp emitter.

4. A method of fabricating a cold cathode comprising a sharp emitter having a sharp tip that is formed on a silicon substrate, wherein said method comprises:

a first step of forming an intermediate emitter on said silicon substrate, said intermediate emitter having at least first and second emitter portions, said second emitter portion being positioned under said first emitter portion, and having a width longer than that of said first emitter portion; and a second step of processing said intermediate emitter into said sharp emitter by oxidation; wherein:

said sharp emitter is composed of silicon;

said first emitter portion being shaped into a sharp emitter portion in said intermediate emitter when said intermediate emitter is processed into said sharp emitter;

said first step comprising:

first forming step of selectively forming a first mask film on said silicon substrate;

first etching step of etching said silicon substrate into an etched silicon substrate having said first emitter portion by using said first mask film as an etching mask;

second forming step of selectively forming a second mask film on a side wall of said first emitter portion; and second etching step of etching said etched silicon substrate into a processed substrate having said sharp emitter under anisotropic chemical etching by using each of said first and second etching masks as an etching mask.

5. A method as claimed in claim 4, wherein:

said second forming step comprising the steps of;

forming a third mask film on said etched silicon substrate by chemical vapor deposition; and selectively removing said third mask film by anisotropic chemical etching to form said second mask film on the side wall of said first emitter portion.

6. A method as claimed in claim 4, wherein:

said second forming step comprising the steps of;

forming a third mask film on said etched silicon substrate by chemical vapor deposition;

selectively removing said third mask film by anisotropic chemical etching to form said second mask film on the side wall of said first emitter portion; and further comprises an intermediate step located between said first step and said second step, said first mask film being removed in said intermediate step.

7. A method as claimed in claim 4, wherein:

said first mask film being a film of nitride.

8. A method as claimed in claim 4, wherein:

said first mask film being a film of nitride;

said second forming step comprising the steps of;

oxidizing said etched silicon substrate into an oxidized substrate having an oxidized silicon film thereon; and etching said oxidized film by anisotropic chemical etching to form said second mask film on the side wall of said first emitter portion.

* * * * *